United States Patent [19]

Pawelko et al.

[11] 4,329,898

[45] May 18, 1982

[54] APPARATUS FOR SUBDIVIDING A WEB OF WRAPPING MATERIAL INTO SECTIONS OF PREDETERMINED LENGTH

[75] Inventors: Karl-Heinz Pawelko, Marschacht; Reinhard Deutsch, Geesthacht, both of Fed. Rep. of Germany

[73] Assignee: Hauni-Werke Körber & Co. KG., Hamburg, Fed. Rep. of Germany

[21] Appl. No.: 126,701

[22] Filed: Mar. 3, 1980

[30] Foreign Application Priority Data

Mar. 30, 1979 [DE] Fed. Rep. of Germany ..... 2912679

[51] Int. Cl.[3] ..... B26D 7/01

[52] U.S. Cl. ..... 83/251; 83/152; 83/154; 83/159; 83/259; 83/282; 83/278; 83/465

[58] Field of Search ..... 83/206, 207, 250, 251, 83/253, 259, 276, 277, 278, 279, 280, 282, 415, 418, 152, 154, 159, 465; 198/859; 226/108, 115, 158, 162, 167; 414/14, 750

[56] References Cited

U.S. PATENT DOCUMENTS

| | | | |
|---|---|---|---|
| 3,073,591 | 1/1963 | Cosentino | 83/276 X |
| 3,094,925 | 6/1963 | Huber | 83/251 X |
| 3,446,499 | 5/1969 | Ringler | 83/251 X |
| 3,469,754 | 9/1969 | Parker | 83/278 X |
| 3,477,627 | 11/1969 | Webers | 226/115 X |
| 3,605,538 | 9/1971 | Bohmer et al. | 83/251 X |
| 3,757,619 | 9/1973 | Gianese | 83/280 X |
| 4,077,289 | 3/1978 | Rudszinat | 83/236 X |
| 4,082,261 | 4/1978 | Johannisson | 83/277 X |

FOREIGN PATENT DOCUMENTS

| | | | |
|---|---|---|---|
| 1019545 | 11/1957 | Fed. Rep. of Germany . | |
| 2132168 | 1/1972 | Fed. Rep. of Germany | 83/206 |

*Primary Examiner*—Frank T. Yost
*Assistant Examiner*—Robert P. Olszewski
*Attorney, Agent, or Firm*—Kontler & Grimes

[57] ABSTRACT

Apparatus for subdividing a web of wrapping material into sections of predetermined length has a reciprocable carriage for a pair of grippers which are pivotable into engagement with the web to thereby clamp the web against the carriage while the latter moves forwardly. This advances the web through a distance which approximates but is less than the distance necessary to advance the web by the length of a section. The grippers are thereupon disengaged from the web while the carriage continues to move forwardly, and the web is braked by one or more brushes so that two pawls whose pallets are biased against the web can catch up with a pair of marginal notches in the web. The pallets enter the respective marginal notches and complete the forward movement of the web. A mobile knife cooperates with a stationary knife to sever the web and to thus separate a section from the leader of the web while the carriage moves rearwardly. The web is prevented from sharing the rearward movement of the carriage by the bristles of one or more stationary blocking brushes. An electromagnetically actuatable holder is provided to prevent any movements of the web when the making of sections is interrupted on purpose.

14 Claims, 5 Drawing Figures

9
19
16
24
11
18
12
21
17
V
28
27
V
38a
38
29
22
36
13
8
14
37
23
CRANK DRIVE
108

28
27
18
29
33
31
26
32
34
233
CAM DRIVE
133

APPARATUS FOR SUBDIVIDING A WEB OF WRAPPING MATERIAL INTO SECTIONS OF PREDETERMINED LENGTH

BACKGROUND OF THE INVENTION

The present invention relates to apparatus for subdividing a web of flexible material into discrete sections, e.g., into blanks which can be used in packing machines for cigarettes or other smokers' products. More particularly, the invention relates to an intermittently operated severing or subdividing apparatus which moves the web in stepwise fashion and is preferably designed to subdivide a web having marginal notches along which the blanks can be folded preparatory to conversion into imprinted or unprinted wrappers, portions of wrappers, envelopes or the like.

It is already known to provide a severing or subdividing apparatus for webs of flexible material (such as paper, cardboard, metallic foil, sheets made of synthetic plastic material or the like) with means for intermittently advancing the web lengthwise so as to place successive selected portions of the web into register with cutting or severing instrumentalities. In many instances, the advancing means includes a first unit which effects a coarse transport of the web through a distance which approximates and somewhat exceeds the length of a section or blank, and a second unit which thereupon moves the web rearwardly so as to eliminate the discrepancy between the extent of coarse transport and the desired length of a blank. Reference may be had to German Auslegeschrift No. 1,019,545. The rearward movement of the web is terminated when suitable detent means penetrate into marginal notches of the web.

A drawback of conventional apparatus of the above outlined character is that the intervals between successive severing steps are rather long. This is due to the fact that the direction of movement of the web must be reversed upon completion of coarse advancement in order to move the aforediscussed marginal notches into register with the detent means.

OBJECTS AND SUMMARY OF THE INVENTION

An object of the invention is to provide a novel and improved apparatus which can subdivide a web, strip or tape into a large number of sections or blanks per unit of time, which can ensure that the length of each severed section or blank invariably matches a preselected value, and which is not only simpler but also more compact and less expensive than heretofore known apparatus.

Another object of the invention is to provide an apparatus wherein the direction of movement of the web need not be reversed upon completion of coarse advancement through a distance approximating the length of a section or blank.

A further object of the invention is to provide an apparatus whose output is sufficiently high to satisfy the requirements of modern high-speed packing machines for cigarettes or like mass-produced articles.

An additional object of the invention is to provide the apparatus with novel and improved means for effecting coarse and precise advancements of a web or the like between successive severing operations.

Another object of the invention is to provide an apparatus which treats the web gently, which can hold the web against any movement when the making of blanks is interrupted on purpose, and which can be installed in many existing machines that require blanks or sections of predetermined length.

An additional object of the invention is to provide an apparatus which can be designed for fully automatic operation in synchronism with the operation of one or more consuming machines, such as one or more packing machines for cigarettes or other rod-shaped smokers' products.

The invention is embodied in an apparatus for subdividing a web, tape, strip or sheet (hereinafter called web) of flexible wrapping or like material into blanks or sections of predetermined length, particularly for subdividing a continuous elongated web having marginal notches which are spaced apart from each other, as considered in the longitudinal direction of the web. The apparatus comprises first advancing means which is actuatable (e.g., by cam means) at intervals to move the web lengthwise in a predetermined direction, always through a distance approximating but being less than the aforementioned predetermined length of a section or blank, second advancing means which is actuatable to engage the web and to complete the movement of the web in the predetermined direction through a distance which matches the predetermined length (i.e., to move the web forwardly through a distance which constitutes the difference between the extent of coarse advancement and the extent which is necessary to advance the web through the desired distance) without any (or without any appreciable) interruption between the movements which the web respectively receives from the first and second advancing means, and a pair of cooperating knives or other suitable means for severing a section or blank from the leader of the web upon completion of each movement of the web through a distance which matches the predetermined length.

One (preferably the first) advancing means comprises or may comprise at least one gripper (e.g., a tongs) which engages the web while the latter is moved by the one advancing means. The other (preferably the second) advancing means can comprise at least one entraining member which enters a notch of the web to thereby advance the web in the aforementioned direction during actuation of the other advancing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3:
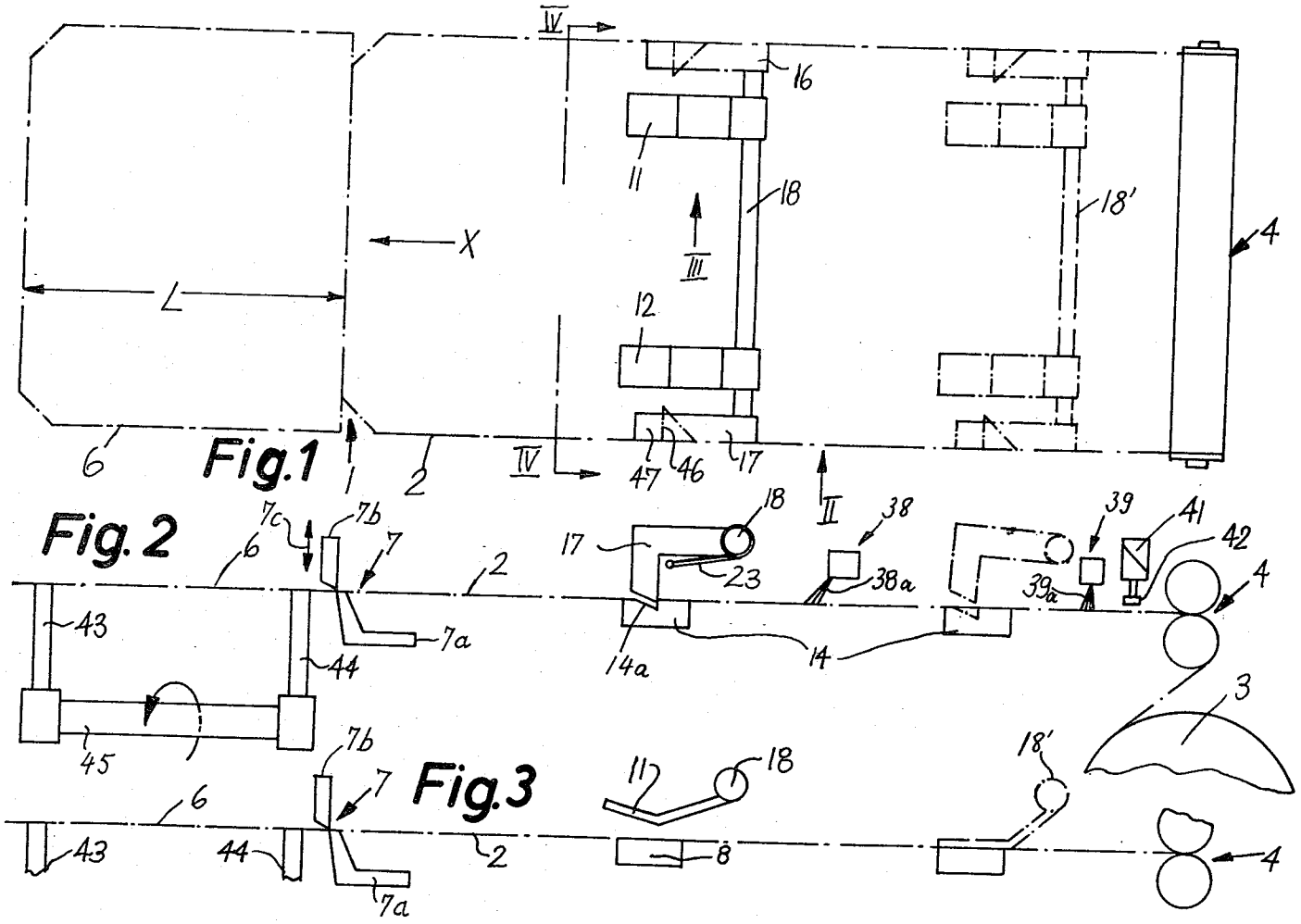
FIG. 1 is a schematic plan view of an apparatus which embodies the invention, the two end positions of the shaft which carries certain components of the first and second advancing means being respectively shown by solid and phantom lines.
FIG. 2 is a schematic side elevational view of the apparatus as seen in the direction of the arrow II in FIG. 1.
FIG. 3 is another side elevational view as seen in the direction of arrow III in FIG. 1, with certain parts of the apparatus omitted for the sake of clarity.

Referring first to FIGS. 1 to 3, there is shown an apparatus which serves to sever the leading end or leader of an intermittently advanced web 2 of flexible material, such as paper, cardboard, metallic foil or a sheet of synthetic plastic material. The marginal portions of the web 2 are provided with substantially triangular notches 1 which are aligned with each other, as considered at right angles to the longitudinal direction of the web. The latter is moved intermittently in the direction which is indicated by the arrow X, always through a predetermined distance which matches the length L of a blank or section 6. The web 2 is stored on the core of a reel 3 or an analogous source of supply and is caused to advance along a substantially horizontal path which is defined, in part, by two guide rolls 4. That portion of the path for the web 2 which is located downstream of the nip of the guide rolls 4 is but need not be horizontal or substantially horizontal.

The apparatus comprises a customary cutting or severing device 7 having a stationary knife or counterknife 7*a* and a mobile knife 7*b*. The latter is movable up and down (see the arrow 7*c*) to sever the web 2 during movement to its lower end position whereby the leader of the web yields a discrete section or blank 6 which can constitute the starting material for the inner, intermediate or outer envelope of a soft cigarette pack or the like. The means for moving the reciprocable knife 7*b* with reference to the counterknife 7*a* is not specifically shown in the drawing; such means can comprise one or more fluid-operated motors, electromagnets or the like which are actuated in response to termination of movement of the web 2 in the direction indicated by the arrow X.

The first and second advancing means for the web 2 are mounted on a carriage 8 which is movable back and forth, namely, in and counter to the direction which is indicated by the arrow X. The means for guiding the carriage 8 along a path which is parallel to the path of movement of the web 2 downstream of the guide rolls 4 comprises an elongated tie rod 9 (see FIG. 4) whose end portions are installed in a stationary frame, not specifically shown. The means for moving the carriage 8 along the tie rod 9 comprises a schematically illustrated crank drive 108; however, it is equally possible to employ a double-acting cylinder and piston unit or any other means which is capable of rapidly moving the carriage forwardly and backwards.

The first advancing means which serves to move the web 2 lengthwise through distances which approximate but are slightly less than the length L of a section or blank 6 comprises two grippers or tongs 11, 12 which share the reciprocatory movements of the carriage 8. The latter can be said to constitute an element of the first advancing means because, when the grippers or tongs 11, 12 are effective to move the web 2 in the direction of the arrow X, they bias the adjacent portions of the web against the carriage 8 to thus compel the web to share the movement of the carriage in a direction to the left, as viewed in FIGS. 1–3. When the carriage 8 moves rearwardly, namely, back to its starting position, the tongs or grippers 11, 12 are disengaged from the web 2 (see the solid-line position of the gripper 11 in FIG. 3).

The second advancing means which effects fine or precision advancement of the web 2 in the direction of the arrow X comprises two male entraining members in the form of pawls 16, 17 which are pivotably mounted in the carriage 8, and two female entraining members or sockets 13, 14, one for each of the pawls 16, 17. The pallets of the pawls 16, 17 extend downwardly through the adjacent notches 1 of the web 2 and into the recesses (see the recess 14*a* in FIG. 2) of the respective sockets when the web 2 is advanced by the second advancing means. The arrangement is such that the second advancing means preferably begins to move the web 2 forwardly, so as to complete the forward movement of the web through the distance L, before the web 2 ceases to advance under the action of or as a result of engagement with the grippers 11, 12. This insures that, once the web 2 is set in motion by the grippers 11, 12, it continues to move (during the last stage under the influence of the entraining members 13, 14 and 16, 17) until it completes a forward movement through the distance L. Such mode of operation results in substantial reduction of the length of intervals between successive severing operations. Also, the carriage 8 can rapidly return to its starting position because the combined mass of parts moving with the carriage is relatively small. The grippers 11, 12 are disengaged from the web 2 before the web completes the movement through the distance L. The arrangement is such that the grippers 11 and 12 are disengaged from the web 2 prior to entry of the pallets of the pawls 16, 17 into the recesses of the respective sockets 13, 14. These sockets are fixedly mounted on the carriage 8.

The grippers 11, 12 of the first advancing means are flanked by the components (13, 16 and 14, 17) of the second advancing means (see particularly FIG. 1), and the shaft 18 which supports the grippers 11, 12 also supports the pawls 16, 17. The shaft 18 is journalled in suitable bearings on or in the carriage 8. Thus, it can be said that the parts of the two advancing means constitute fixedly mounted and/or mobile components of the carriage 8. The grippers 11, 12 are fixed to and thus share all angular movements of the shaft 18. On the other hand, the pawls 16, 17 can pivot about the axis of the shaft 18. The pawls 16 and 17 are respectively biased in a counterclockwise direction, as viewed in FIG. 2, by discrete torsion springs 19, 21 portions of which are coiled around the shaft 18 (see FIG. 4). The means for intermittently lifting the pallets of the pawls 16, 17 above the path of the web 2 comprises levers 22 and 23 which are fixed to the shaft 18 so that they automatically raise the respective pawls when the shaft 18 is caused to turn in a clockwise direction, as viewed in FIG. 2. A further torsion spring 24 is provided to bias the shaft 18 in a counterclockwise direction, as viewed in FIG. 3, i.e., to urge the grippers 11 and 12 toward and against the upper side of the web 2. The torsion spring 24 reacts against the carriage 8.

Figure 4:
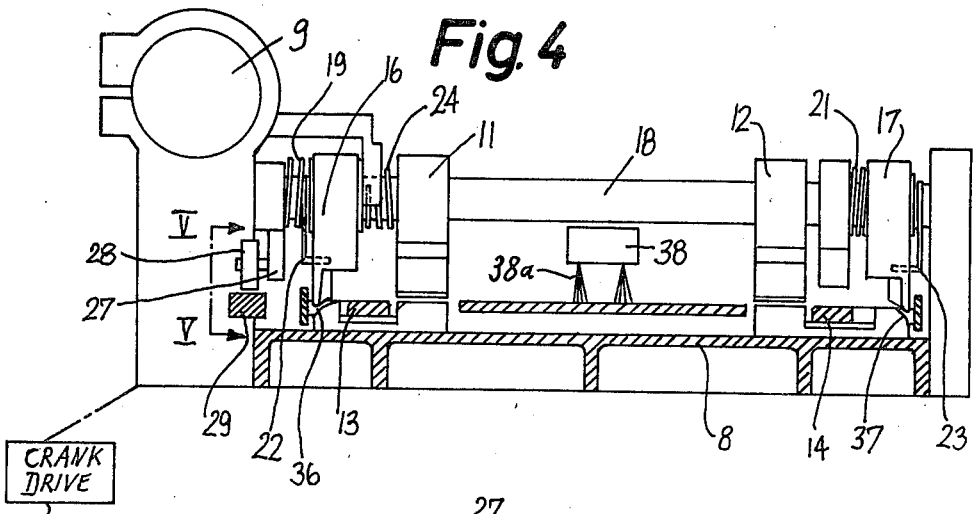
FIG. 4 is an enlarged transverse vertical sectional view as seen in the direction of arrows from the line IV—IV of FIG. 1.
Figure 5:
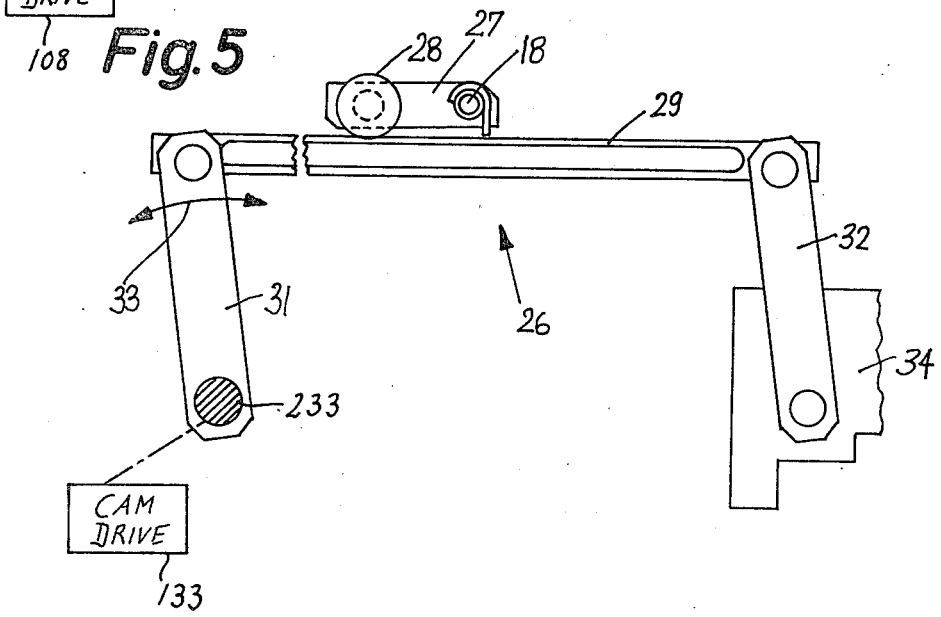
FIG. 5 is a fragmentary sectional view as seen in the direction of arrows from the line V—V of FIG. 4.

The means 26 for controlling the movements of the shaft 18 about its axis includes certain components which are illustrated in FIGS. 4 and 5. These components include a motion transmitting lever 27 one end portion of which is rigid with the shaft 18 and the other end portion of which carries a roller follower 28, and an adjustable cam track 29 in the form of a rail whose end portions are articulately connected with parallel links 31, 32 mounted on a stationary carrier 34. One of the links 31, 32 (e.g., the link 31) is rockable back and forth (see the double-headed arrow 33 in FIG. 5) by a cam drive 133 which transmits torque to a shaft 233 fixedly attached to the link 31. The details of the cam drive 133 form no part of the present invention; all that counts is to ensure that the shaft 233 will be rocked back and forth at preselected intervals and in certain positions of the reciprocable carriage 8. Depending on the inclination of the cam track 29 and on the position of the carriage 8 (i.e., on the position of the roller follower 28 with reference to the one or the other end of the cam track), the motion transmitting lever 27 maintains the shaft 18 in a preselected angular position which, in turn, determines whether or not the grippers 11, 12 engage the web 2.

That portion of the carriage 8 which is located in the path of movement of the pallets of the pawls 16 and 17 includes arcuate supporting surfaces 36 and 37 for the respective portions of the web 2. Furthermore, the apparatus comprises blocking means in the form of one or more brushes 38 having bristles 38*a* which are inclined forwardly and downwardly, as considered in the direction of the arrow X, to prevent rearward movement of the web 2 when the carriage 8 moves counter to the direction indicated by the arrow X. Braking means in the form of one or more brushes 39 comprises bristles 39*a* which are normal or substantially normal to the plane of the web 2 and serve to decelerate and arrest the web 2 as soon as the latter is not advanced by the grippers 11, 12 and/or pawls 16, 17. Still further, the apparatus comprises holding means 42 in the form of a plunger or pusher actuatable by an electromagnet 41 in order to engage the web 2 behind the carriage 8 and to arrest the web when the carriage moves forwardly (arrow X) while the web is not engaged by the grippers 11, 12 and/or pawls 16, 17.

Finally, the apparatus comprises means for removing successive sections or blanks 6 from the path of movement of the web 2 so that the leader of the web can be advanced beyond the cutting device 7. Such removing means comprises suction cups 43 and 44 mounted on a shaft 45 which is parallel to the direction indicated by the arrow X and can cause the suction cups to pivot in planes which are normal to the plane of the web 2.

The operation of the apparatus is as follows:

The shaft 18 is located in the phantom-line position 18′ of FIGS. 1 and 3 at the start of a cycle, i.e., before the apparatus begins to advance the web 2 through a distance corresponding to the length L of a blank 6. The grippers 11 and 12 bear against the upper side of the web 2 under the action of the torsion spring 24 for the shaft 18. The crank drive 108 advances the carriage 8 in the direction of the arrow X whereby the grippers 11 and 12 entrain the web 2 and move it through a distance which is somewhat less than L. The force with which the grippers 11, 12 engage the web 2 suffices to withdraw the latter from the reel 3 and to cause the web to pass between the guide rolls 4. The pawls 16, 17 do not extend into the recesses of the respective sockets 13, 14, i.e., the second advancing means is not effective and the web 2 advances solely under the action of the first advancing means (the grippers 11, 12 and the corresponding portions of the carriage 8). The pallets of the pawls 16, 17 are biased against the upper side of the web 2 under the action of the torsion springs 19 and 21. This is due to the fact that the roller follower 28 maintains the lever 27 in the lowermost angular position in view of the corresponding inclination of the links 31, 32 for the cam 29. The roller follower 28 rolls along the cam 29 and, shortly before the carriage 8 reaches the solid-line position of FIG. 3, the links 31 and 32 are pivoted in a direction to the right, as viewed in FIG. 5. Therefore, the position of the cam 29 changes (the cam is moved to a higher level) to a predetermined extent whereby the lever 27 is pivoted clockwise to turn the shaft 18 through an angle which suffices to disengage the grippers 11 and 12 from the upper side of the web 2. The brushes 39 immediately brake the web 2 so that the sockets 13, 14 and pawls 16, 17 catch up with the leading edges 46 of two transversely aligned notches 1. The torsion springs 19 and 21 cause the pallets of the pawls 16, 17 to flex the adjacent portions of the web 2 against the curved supporting surfaces 36 and 37 of the carriage 8 to form flaps 47 which reinforce (stiffen) the edges 46. The sockets 13, 14 then cooperate with the pawls 16, 17 to advance the web 2 through a relatively small distance so that the combined extent of advancement of the web under the action of the first advancing means (grippers 11, 12 and the corresponding portions of the carriage 8) and second advancing means 13, 14, 16, 17 equals the length L of a section 6. Since the forward movement of the carriage 8 takes place simultaneously with the rightward pivotal movement of the links 31, 32 beyond the positions shown in FIG. 5, the cam 29 is held in the uppermost position when the carriage 8 comes to a standstill, i.e., before the carriage begins to move rearwardly. At such time, the levers 22 and 23 maintain the pallets of the pawls 16, 17 out of contact with the web 2, i.e., the torsion springs 19 and 21 store energy. The levers 31 and 32 leave their upright or vertical positions (uppermost position of the cam 29) when the carrige 8 reassumes the starting position in which the shaft 18 is held in the position 18′. The blocking brush or brushes 38 are effective during rearward movement of the carriage 8 to prevent the web 2 from sharing any part or parts of such movement. The inclination of the bristles 38*a* is sufficient to ensure that frictional forces, if any, between the carriage 8 and the web 2 (while the carriage moves rearwardly) cannot entail any movement of the web counter to the direction indicated by the arrow X.

If the forward transport of the web 2 is to be interrupted while the carriage 8 continues to move back and forth, the electromagnet 41 is energized to move the pusher 42 downwardly (FIG. 2) and into frictional engagement with the web 2. This suffices to ensure that the web 2 is held against movement in either direction (in or counter to that indicated by the arrow X) as long as the electromagnet 41 remains energized. The latter is energized when the carriage 8 moves forwardly while the web 2 is not engaged by the grippers 11, 12 and/or pawls 16, 17, i.e., when the first as well as the second advancing means are idle. The apparatus preferably further comprises means for holding and locking the grippers 11, 12 and pawls 16, 17 in positions of disengagement from the web 2. Such holding and locking means can comprise a brake or the like which holds the shaft 18 in a preselected angular position irrespective of the level or inclination of the cam 29. As mentioned above, the holding device 42 is located behind the carriage 8, as considered in the direction of the arrow X.

The cutting device 7 can sever the web 2 while the carriage 8 moves rearwardly, i.e., while the web is idle. This simplifies the severing operation and renders it possible to employ a relatively simple, compact and inexpensive severing or cutting device. The blank or section 6 which is separated from the leader of the web 2 is attracted by the suction cups 43, 44 and is moved laterally and away from the path for the web 2 in response to rotation of the shaft 45. As mentioned above, such blanks or sections can be converted into the inner, outer or intermediate envelopes of soft cigarette packs or the like.

An important advantage of the improved apparatus is that it can satisfy the requirements of latest high-speed cigarette packing and like machines wherein blanks must be supplied at frequent intervals and the length of each blank should match a predetermined value. The speed of packing machines for cigarettes or the like has increased during the last years to such an extent that heretofore known severing apparatus are not capable of satisfying the requirements of these machines or that the conventional severing apparatus can satisfy such requirements only by reducing the quality of their output, i.e., by furnishing blanks whose length often deviates from the desired optimum length. Furthermore, conventional severing apparatus are likely to tear, deface and/or otherwise damage the web if their operational speed is increased beyond a certain value which does not suffice for use of conventional apparatus in connection with the latest versions of cigarette packers or like machines.

Another important advantage of the improved apparatus is that it is surprisingly compact, simple, reliable and inexpensive. Therefore, the apparatus requires a minimum of maintenance. Moreover, the apparatus can be used for the subdivision of a wide variety of webs including relatively stiff or relatively soft, relatively narrow or relatively wide and/or relatively thick or relatively thin webs.

The output of the apparatus is very high due to the fact that the intervals between advancements of the web by the first and second advancing means are extremely short or nil. Thus, there is a smooth and practically immediate transition from advancement of the web by the grippers or tongs 11, 12 to transport of the web by the pawls 16 and 17. The sockets 13, 14 are desirable but not critical; an important function of these sockets is to limit the extent of counterclockwise pivotal movement of the pawls 16, 17, as viewed in FIG. 2 of the drawing. Since the extent to which the web 2 is advanced under the action of the grippers 11, 12 is invariably less than is necessary to complete the transport of the web forwardly through a distance matching the desired length L of a section 6, the direction of movement of the web need not be reversed preparatory to and/or during the last stage of its transport in the direction of arrow X, i.e., before the movable knife 7*b* descends to sever the web in cooperation with the counterknife 7*a*.

The likelihood of damage to the web 2 is very remote because the grippers 11, 12 are designed in such a way that they gently press against the upper side of the web 2 with a force which is sufficient to prevent any slippage between the web and the carriage 8 during coarse advancement of the web. Also, the bias of the torsion springs 19, 21 can be readily selected in such a way that the pallets of the pawls 16, 17 cannot damage the web before or while they enter the nearest notches 1 in the corresponding marginal portions of the web. It has been found that the improved advancing means are highly unlikely to tear, deface, unduly crease and/or otherwise damage the web 2 and/or the blanks 6.

The supporting surfaces 36, 37 of the carriage 8 enable the pawls 16, 17 to reinforce the web 2 in the region of the notches 1 so that the web is not likely to tear when it is transported by the pallets of the pawls to complete its forward movement through a distance corresponding to the length L of a section 6.

The brush or brushes 39 prevent an overshooting of the carriage 8, i.e., such movement of the carriage in the direction of the arrow X that the pallets of the pawls 16, 17 would be unable to penetrate into the respective notches 1. As a rule, the speed at which the web 2 is moved by the grippers 11, 12 is rather high in order to achieve a high output; therefore, the provision of one or more braking brushes 39 is quite desirable and advantageous in order to ensure that the pallets of the pawls 16, 17 find their way into the notches and thereupon complete the forward transport of the web 2 prior to actuation of the severing device 7. The latter can be actuated in automatic response to start of movement of the carriage 8 in a direction counter to that indicated by the arrow X.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for subdividing a continuous elongated web of flexible material having notches which are provided in at least one marginal portion thereof and are spaced apart from each other, as considered in the longitudinal direction of the web, into sections of predetermined length, comprising first advancing means which is actuatable at intervals to move the web lengthwise in a predetermined direction, always through a distance approximating but being less than said predetermined length, said first advancing means comprising at least one gripper which engages the web while the web is moved by said first advancing means; second advancing means which is actuatable to engage the web and to complete the movement of the web in said direction through a distance which matches said predetermined length without appreciable interruption between the movements which the web respectively receives from said first and second advancing means, said second advancing means comprising at least one entraining member which enters a notch of the web to thereby advance the web in said direction during actuation of said second advancing means; means for maintaining the notch which is about to be entered into by said entraining member in a predetermined position; and means for severing a section from the leader of the web upon completion of each movement of the web through a distance which matches said predetermined length.

2. The apparatus of claim 1, wherein each of said notches is bounded by at least one edge face of the web and said maintaining means includes a member which is movable into and from engagement with the material of the web in the region of the edge face bounding the notch which is about to be entered by said entraining member.

3. The apparatus of claim 1, further comprising means for braking the web so that the latter is arrested as soon as it completes a movement in said direction through a distance matching said predetermined length.

4. The apparatus of claim 1, wherein each of said advancing means comprises a plurality of web-engaging components.

5. The apparatus of claim 4, wherein the components of one of said advancing means are disposed between the components of the other of said advancing means.

6. The apparatus of claim 1, further comprising means for disengaging said first advancing means for the web not later than upon engagement of the web by said second advancing means.

7. Apparatus for subdividing a continuous elongated web of textile material having notches which are provided in at least one marginal portion thereof and are spaced apart from each other, as considered in the longitudinal direction of the web, into sections of predetermined length, comprising first advancing means which is actuatable at intervals to move the web lengthwise in a predetermined direction, always through a distance approximating but being less than said predetermined length, said first advancing means comprising at least one gripper which engages the web while the web is moved by said first advancing means; second advancing means which is actuatable to engage the web and to complete the movement of the web in said direction through a distance which matches said predetermined length without appreciable interruption between the movements which the web respectively receives from said first and second advancing means, said second advancing means comprising at least one entraining member which enters a notch of the web to thereby advance the web in said direction during actuation of said second advancing means; a carriage for said first and second advancing means; means for moving said carriage back and forth in and counter to said direction; and means for severing a section from the leader of the web upon completion of each movement of the web through a distance which matches said predetermined length.

8. The apparatus of claim 7, further comprising means for maintaining selected portions of the moving web in the range of said second advancing means not later than during the last stage of movement of the web under the action of said first advancing means, said carriage having at least one surface against which a selected portion of the web is biased by said maintaining means.

9. The apparatus of claim 8, wherein said surface of said carriage is an arcuate surface.

10. The apparatus of claim 7, further comprising means for preventing the movement of said web with said carriage while the latter moves counter to said direction.

11. The apparatus of claim 10, wherein said preventing means comprises at least one brush having bristles which engage the web at least while said carriage moves counter to said direction.

12. The apparatus of claim 7, further comprising means for holding the web against movement with said carriage when said carriage moves in said direction while said first and second advancing means are disengaged from the web.

13. The apparatus of claim 12, wherein said holding means includes a member which engages the web at a locus remote from and located behind said severing means, as considered in said direction.

14. The apparatus of claim 13, further comprising electromagnetic actuating means for said holding means.

* * * * *